US008520886B2

(12) United States Patent
Wilk

(10) Patent No.: US 8,520,886 B2
(45) Date of Patent: Aug. 27, 2013

(54) SPEAKER HAVING A HORIZONTAL FORMER

(75) Inventor: Christopher Raymond Wilk, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 294 days.

(21) Appl. No.: 12/985,024

(22) Filed: Jan. 5, 2011

(65) Prior Publication Data

US 2012/0121121 A1 May 17, 2012

Related U.S. Application Data

(60) Provisional application No. 61/413,185, filed on Nov. 12, 2010.

(51) Int. Cl.
*H04R 1/02* (2006.01)
*H04R 1/00* (2006.01)

(52) U.S. Cl.
USPC ..... 381/407; 381/386

(58) Field of Classification Search
USPC ..... 381/337, 345, 347, 349, 350, 352, 381/386, 407; 181/185, 186, 199
See application file for complete search history.

(56) References Cited

U.S. PATENT DOCUMENTS

| | | | | |
|---|---|---|---|---|
| 4,591,667 | A | 5/1986 | Hino et al. | |
| 4,752,963 | A | 6/1988 | Yamazaki et al. | |
| 4,799,266 | A | 1/1989 | Sakamoto et al. | |
| 5,940,522 | A | 8/1999 | Cahill et al. | |
| 6,088,466 | A | 7/2000 | Proni | |
| 6,993,146 | B2 | 1/2006 | Sato | |
| 6,993,147 | B2 | 1/2006 | Guenther | |
| 7,505,603 | B2 | 3/2009 | Yoo | |
| 8,325,968 | B2 * | 12/2012 | Pan et al. | 381/398 |
| 2001/0017928 | A1 * | 8/2001 | Sugiyama et al. | 381/396 |
| 2003/0068063 | A1 * | 4/2003 | Usuki et al. | 381/396 |
| 2007/0025587 | A1 | 2/2007 | Hlibowicki | |
| 2009/0226018 | A1 | 9/2009 | Nielsen et al. | |
| 2010/0215209 | A1 | 8/2010 | Frasl | |

FOREIGN PATENT DOCUMENTS

| | | | |
|---|---|---|---|
| EP | 1799011 | A1 | 6/2007 |
| EP | 1845750 | A1 | 10/2007 |

OTHER PUBLICATIONS

European Search Report (dated Jan. 30, 2012), Application No. 11188464.9-2225—Date Filed—Nov. 9, 2011, (6 pages).

PCT International Search Report and Written Opinion (dated Mar. 2, 2012), International Application No. PCT/US2011/059808, International Filing Date—Nov. 8, 2011, (12 pages).

* cited by examiner

*Primary Examiner* — Brian Ensey
(74) *Attorney, Agent, or Firm* — Blakely, Sokoloff, Taylor & Zafman LLP

(57) ABSTRACT

A speaker includes a frame, a sound radiating surface, and a suspension that couples the sound radiating surface to the frame. A horizontal former is coupled to the radiating surface. The former extends substantially horizontally outward of a peripheral portion of the radiating surface, to a peripheral portion that is separate from the suspension. A coil is coupled to the peripheral portion of the horizontal former.

24 Claims, 7 Drawing Sheets

SPEAKER HAVING A HORIZONTAL FORMER

This application claims the benefit of the earlier filing date of provisional application No. 61/413,185, filed Nov. 12, 2010.

An embodiment of the invention is directed to a speaker that has a relatively small back volume. Other embodiments are also described and claimed.

BACKGROUND

In modern consumer electronics, audio capability is playing an increasingly larger role as improvements in digital audio signal processing and audio content delivery continue to happen. There is a range of consumer electronics devices that are not dedicated or specialized audio playback devices, yet can benefit from improved audio performance. For instance, smart phones are ubiquitous. These devices, however, do not have sufficient space to house high fidelity speakers. This is also true for portable personal computers such as laptop, notebook, and tablet computers, and, to a lesser extent, desktop personal computers with built-in speakers. Such devices typically require speaker enclosures or boxes that have relatively small back volume, as compared to, for instance, stand alone high fidelity speakers and dedicated digital music systems for handheld media players. In small back volume speaker boxes, there is an advantage to using speakers that have relatively small effective piston area (referred to as "Sd") in order to improve low frequency performance. However, in conventional speakers, smaller piston area translates to a smaller voice coil and magnet system, because the voice coil is typically attached in the area between the suspension and the piston. A small voice coil and magnet system means that the force generated by the coil is smaller (when an audio signal is being applied to the speaker). Therefore, any gains in low frequency performance that might be made by adopting a smaller piston area may be lost because of a reduced sensitivity due to the lower force that is generated by the coil and magnet system. Previous efforts to address this problem have focused on providing a stronger magnet system and/or greater signal power to the coil.

SUMMARY

An embodiment of the invention is a speaker having a frame, a sound radiating surface, and a suspension that couples the sound radiating surface to the frame to allow substantially vertical movement of the sound radiating surface relative to the frame. A horizontal former is coupled to the sound radiating surface. The former extends substantially horizontally outward of a peripheral portion of the sound radiating surface, to a peripheral portion that is separate from the suspension. A coil is coupled to the peripheral portion of the horizontal former. This enables the mounting location of the coil to move further outward, thereby substantially increasing the size or area that is spanned by the coil. As a result, a larger coil and magnet assembly is realized, while maintaining the same piston area of the sound radiating surface. This enables the design of a speaker that has a relatively small piston area, for use in relatively small back volume enclosures, but that may have improved performance.

In one embodiment, the peripheral portion of the horizontal former is entirely flat, and the coil is attached to the bottom face of the flat peripheral portion. In another embodiment, the peripheral portion of the horizontal former has an L-shape, which includes a horizontal segment and an adjoining vertical segment. The coil in that case may be attached to the vertical segment. In yet another embodiment, the horizontal former has a number of holes formed therein through which there is airflow between a space just behind the suspension and a space just behind the sound radiating surface. This may improve airflow inside the speaker, thereby improving speaker sensitivity. In addition, such venting may also help cool the coil during heavy usage, such as at higher power levels. The horizontal former may be made of a metal that can also act as a further heat sink to the coil.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

In this section we shall explain several preferred embodiments of this invention with reference to the appended drawings. Whenever the shapes, relative positions and other aspects of the parts described in the embodiments are not clearly defined, the scope of the invention is not limited only to the parts shown, which are meant merely for the purpose of illustration. Also, while numerous details are set forth, it is understood that some embodiments of the invention may be practiced without these details. In other instances, well-known structures and techniques have not been shown in detail so as not to obscure the understanding of this description.

Figure 1:
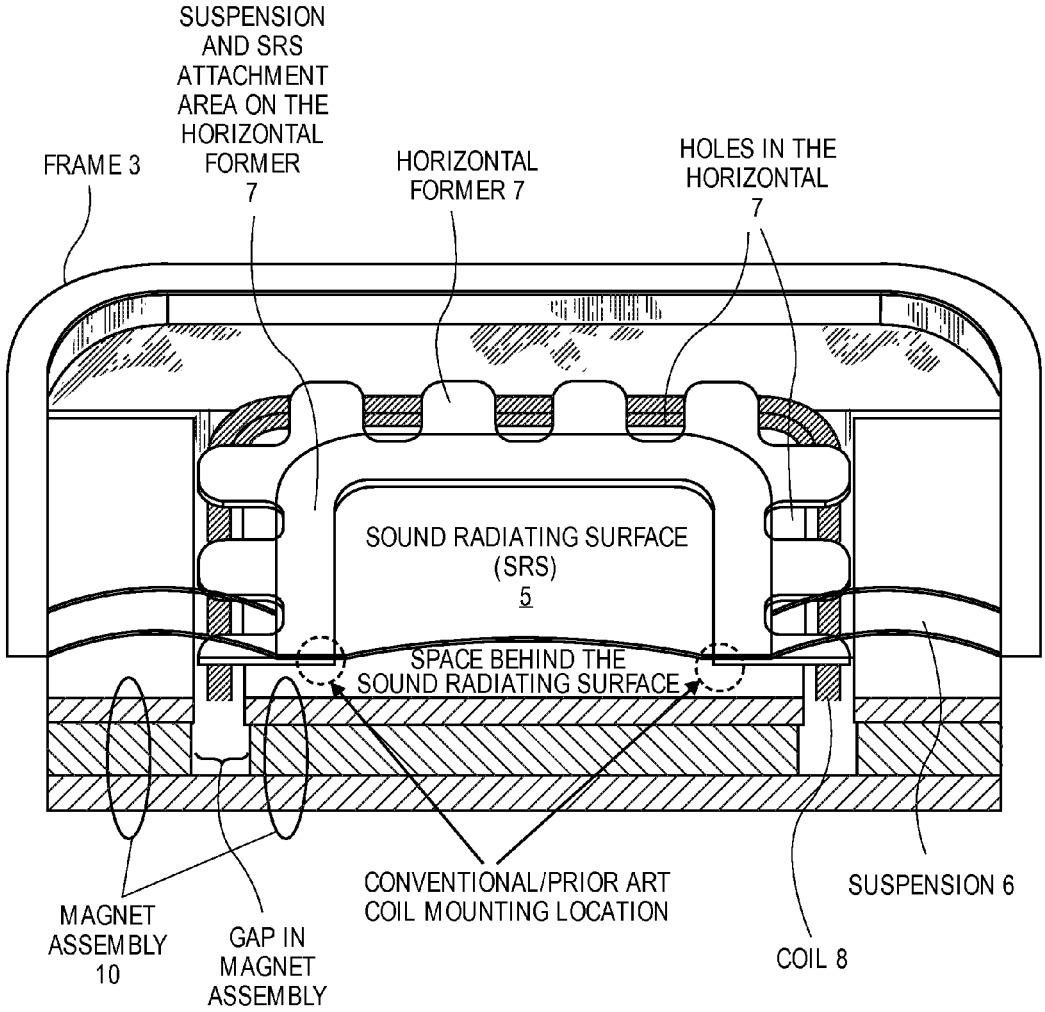
FIG. 1 is an angle view of a speaker having a horizontal former with a flat peripheral portion.
Figure 7:
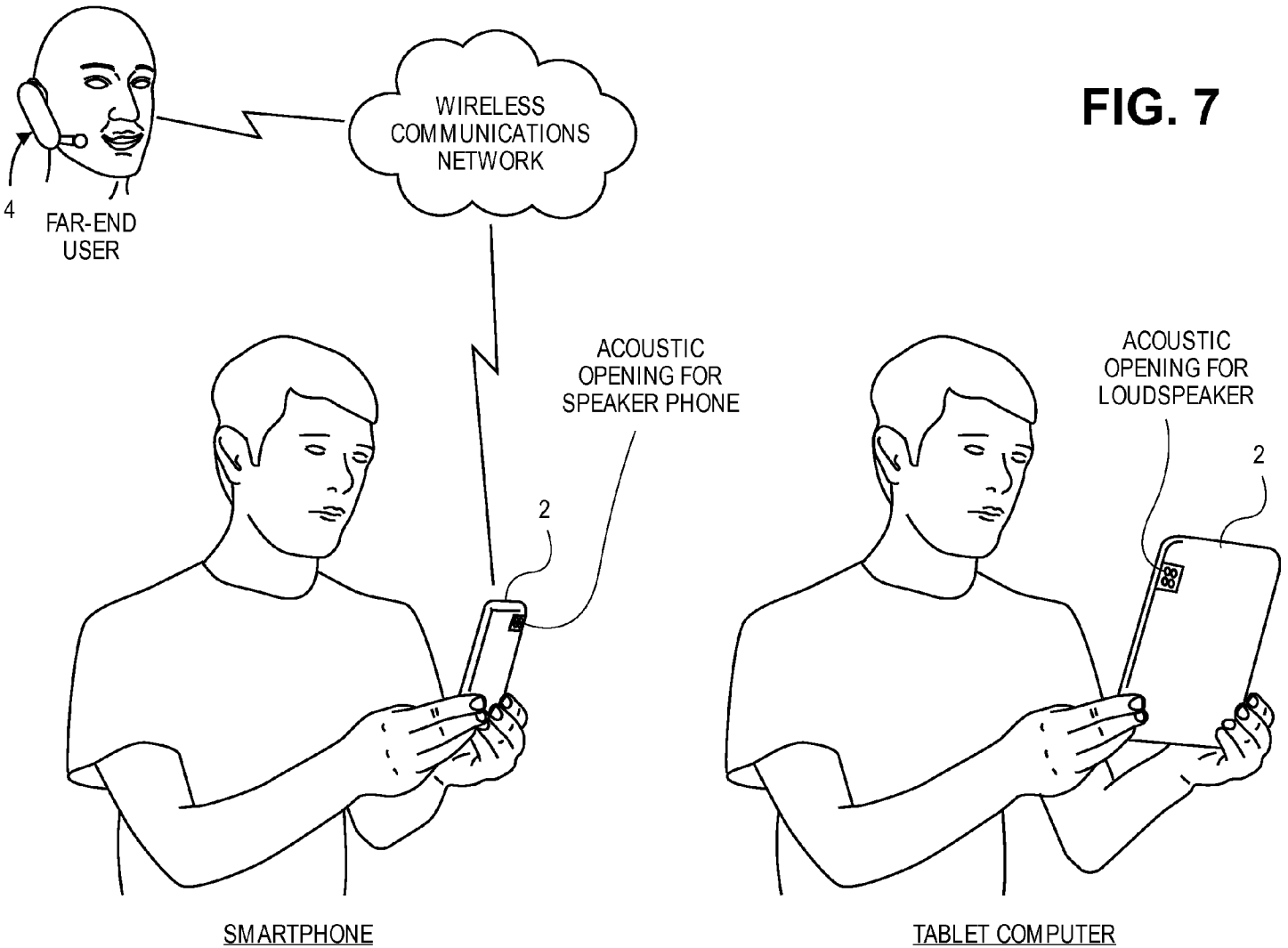
FIG. 7 depicts two instances of consumer electronics devices that typically specify small back volume speakers in which an embodiment of the invention may be implemented.

FIG. 1 is an angle view of a speaker having a horizontal former with a flat peripheral portion. The speaker is built into a frame 3 which may be of a typical material used for speaker enclosures, such as plastic. The frame 3 may be part of a speaker enclosure or box whose speaker back volume is considered to be relatively small, for example, in the range of about 0.5 cubic cm to 2 cubic cm. The concepts described here, however, need not be limited to speaker enclosures whose back volume is in that range. As seen in FIG. 7, such a speaker may be a speakerphone unit that is integrated within a consumer electronic device 2 such as a smart phone with which a user can conduct a call with a far-end user of a communications device 4 over a wireless communications network; in another example, the speaker may be integrated within the housing of a tablet computer. These are just two examples of where the speaker may be used.

A sound radiating surface 5 (or "cone", as used generically) is coupled to the frame 3 by way of a suspension 6. The cone may be a flat plate, or it may be a dome; the latter is likely to weigh less but may provide less high frequency performance (for the same area size). The suspension 6 allows substantially vertical movement of the sound radiating surface 5, that is in a substantially up and down direction or also referred to as a forward-backward direction, relative to the fixed frame 3. The suspension 6 may be any flexible material such as foam or rubber or membrane made of a thermoformed plastic that is sufficiently flexible to allow movement of the sound radiating surface in order to produce acoustic or sound waves. In contrast, the sound radiating surface may be more rigid or less flexible, to be more efficient in producing high frequency acoustic waves. In one instance, the suspension 6 is an outer portion of a single-piece flexible membrane, and the cone (sound radiating surface 5) includes a rigid plate or dome that may be attached to an inner portion of the flexible membrane. This may be done by directly gluing the cone to the top face of the flexible membrane; alternatively, the cone may be bonded directly to the top face of an inner portion of the horizontal former 7, next to where the flexible membrane is bonded. The suspension 6 may also be viewed as an annular surround that is attached to the sound radiating surface 5, along a peripheral portion of the latter. The suspension 6 may also serve to maintain the sound radiating surface 5 in substantial alignment relative to a center vertical axis of the radiating surface 5 during operation of the speaker. This alignment also serves to prevent a moving coil 8 from getting snagged by the walls of the magnet system.

Figure 2:
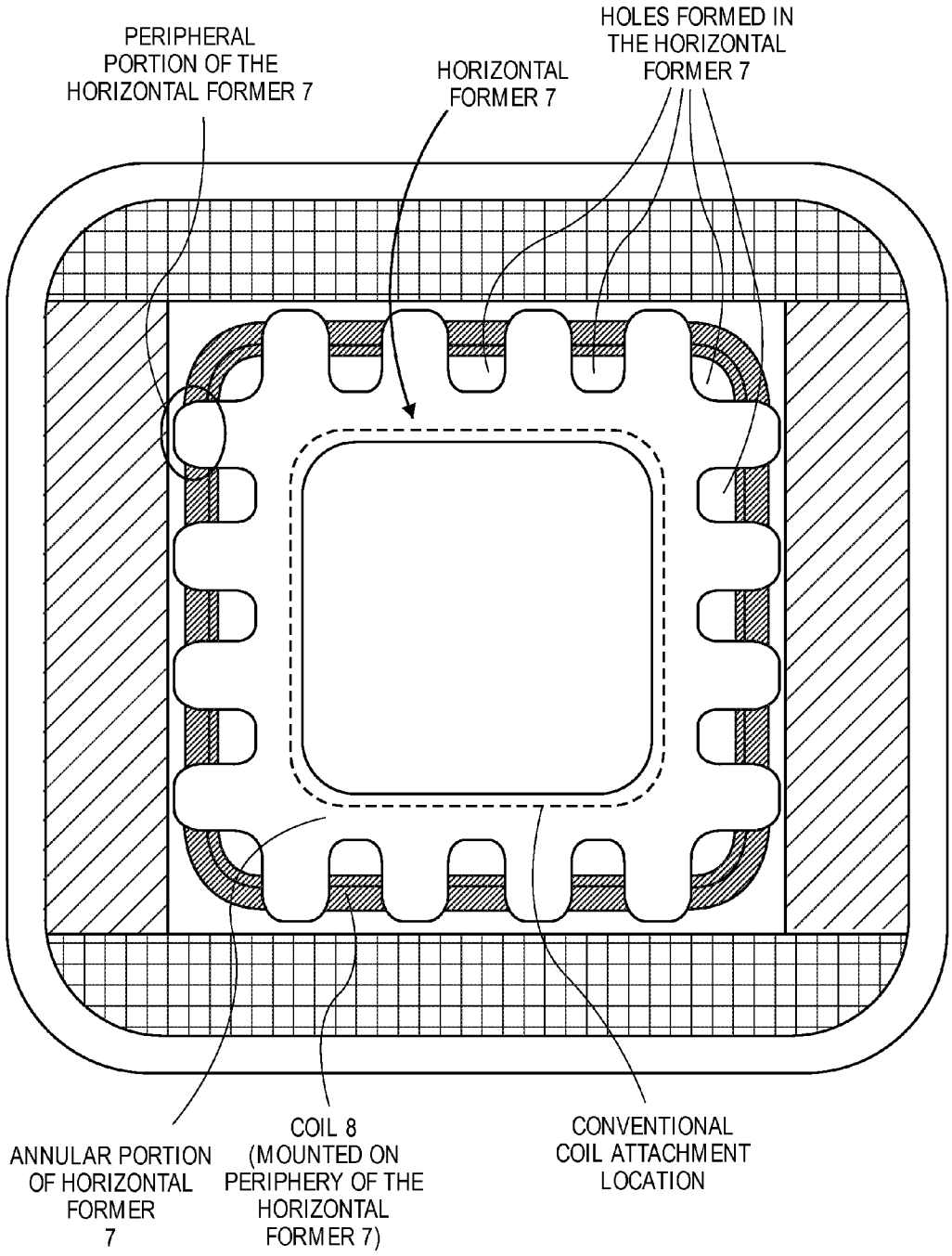
FIG. 2 is a top view of the embodiment of FIG. 1.
Figure 3:
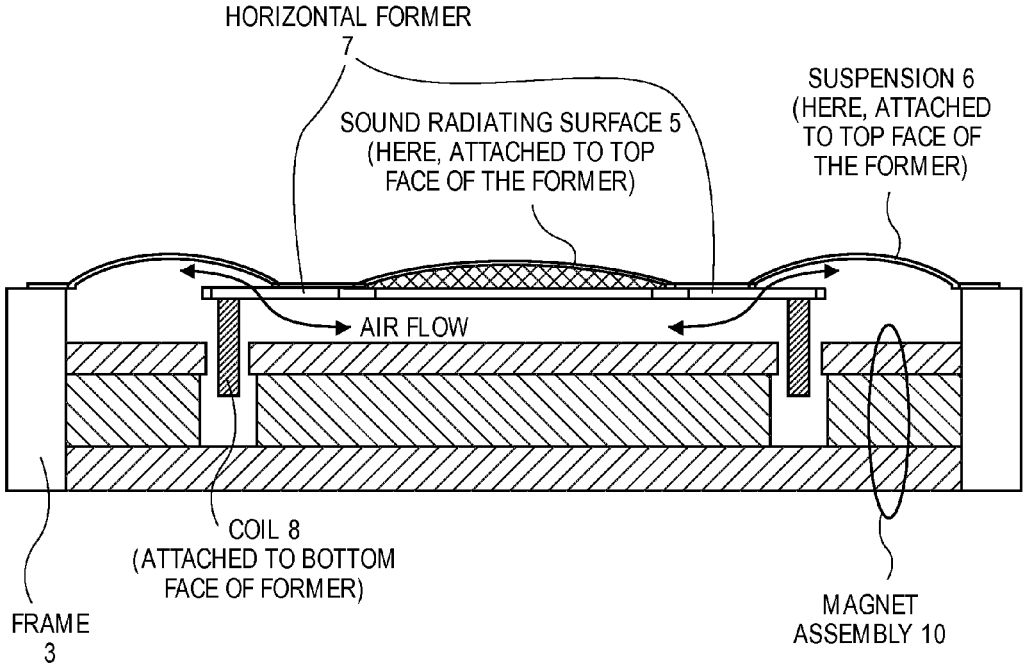
FIG. 3 is a side view of the embodiment of FIG. 1.

The speaker also has a horizontal former 7, where this term has been borrowed from a conventional voice coil former around which a voice coil is typically wound. While the horizontal former 7 is coupled to the sound radiating surface 5, it is, of course, different in structure than a conventional voice coil former. In particular, it may be a flat plate with a central opening therein (as best seen in the top view of FIG. 3), which extends substantially horizontally outward of a peripheral portion of the sound radiating surface 5, to a peripheral portion that is separate from the suspension 6. This can be seen clearly in FIG. 1 as well as in FIG. 2. The horizontal former 7 extends substantially horizontally outward of the external boundary portion or surface portion of the sound radiating surface 5 as seen in FIG. 2. The sound radiating surface 5 or cone may be a flat plate or it may be a dome that has been attached to a top face of the annular portion of the horizontal former 7. A dome-type of radiating surface 5 is depicted in FIG. 3, where it is attached to the top face of the horizontal former 7.

Referring back to FIG. 1, the peripheral portion of the horizontal former 7 can be seen as being separate from the suspension 6; a coil 8 (also referred to as a voice coil) is coupled to this peripheral portion as shown. Although not show, the coil 8 has electrical connections to a pair of terminals through which an input audio signal is received, in response to which the coil 8 produces a changing magnetic field that interacts with the magnetic field produced by the magnet assembly 10, for driving the speaker. The coil 8 may be a pre-wound wire coil unit that has been shaped to conform, generally speaking, to the shape of the gap in the magnet assembly 10, in this example a substantially square or rectangular shape. The horizontal extension is designed to create a substantial increase in the size or area spanned by the attached voice coil 8, relative to the conventional location of a coil attachment which may be at approximately the periphery of the sound radiating surface 5—see FIG. 2. Note also that the peripheral portion of the horizontal former 7 may be angled slightly downward, that is away from the bottom face of the suspension 6, or even slightly upward, but in both of these cases the former 7 would still be considered as extending substantially horizontally outward, because it would still yield a substantial area increase to the attached coil 8.

The horizontal former 7 may be made from any suitably lightweight yet rigid material, so as to keep the weight of the suspended combination with the sound radiating surface 5 to a minimum, for greater performance and efficiency. An example material is an aluminum alloy. To achieve reduced weight, the horizontal former 7 may also be made thinner, although not so thin as to bend during operation of the speaker. Other suitable materials include titanium and ceramic, both of which may be made sufficiently lightweight yet rigid. Another technique to reduce the weight of the former 7 is to give it an essentially annular shape that has a central opening as shown in the figures (rather than a solid shape). The former 7 may be manufactured as a separate piece, prior to being joined to the sound radiating surface 5, the suspension 6, and the coil 8.

In one embodiment, the horizontal former 7 may be viewed as rigidly connecting the coil 8 to the cone 5 in such a manner that the area spanned by (the closed loop of) the coil 8 is larger than the solid area of the cone 5.

To complete the schematic of the speaker depicted in the figures, a speaker magnet assembly 10 is fixed to the frame 3. The magnet assembly 10 in this case includes a permanent magnet sandwiched by a top plate and a bottom plate. This provides an air gap in which the coil 8 is received for free movement therein (as depicted in the figures). Other magnet assemblies that can provide a sufficiently strong magnetic flux (within a suitably shaped air gap for the coil) are possible.

In the embodiment depicted in FIGS. 1-3, the peripheral portion of the horizontal former 7 is entirely flat as shown, where the coil 8 is attached to the bottom face of the flat peripheral portion. The coil 8 may be a pre-wound coil assembly (which includes the wire coil held in its intended position by a lacquer or other adhesive material), which may be bonded directly to the bottom face of the horizontal former, at the peripheral portion of the latter. Other ways of attaching or forming the coil 8 in such a fixed position (relative to the horizontal former 7) are possible.

FIGS. 1-3 also show a further embodiment of the invention, where the horizontal former 7 has a number of holes or openings formed therein through which there is airflow between a space just behind the suspension 6 and a space just behind the sound radiating surface 5. See FIG. 3 for a schematic view of the airflow between those two spaces. In the embodiments shown, the holes are formed at the outside edge of the periphery of the former 7, in the form of notches or indentations that separate adjacent fingers, and where the coil 8 has been mounted to the bottom face of such fingers. As an alternative to the finger arrangement shown, the holes may be formed slightly inward of the outside edge. In both cases, these holes improve airflow inside the speaker, which may improve speaker sensitivity. Moreover, the holes may help cool the coil, thereby allowing the speaker to perform well at higher power levels and longer operation intervals.

Figure 4:
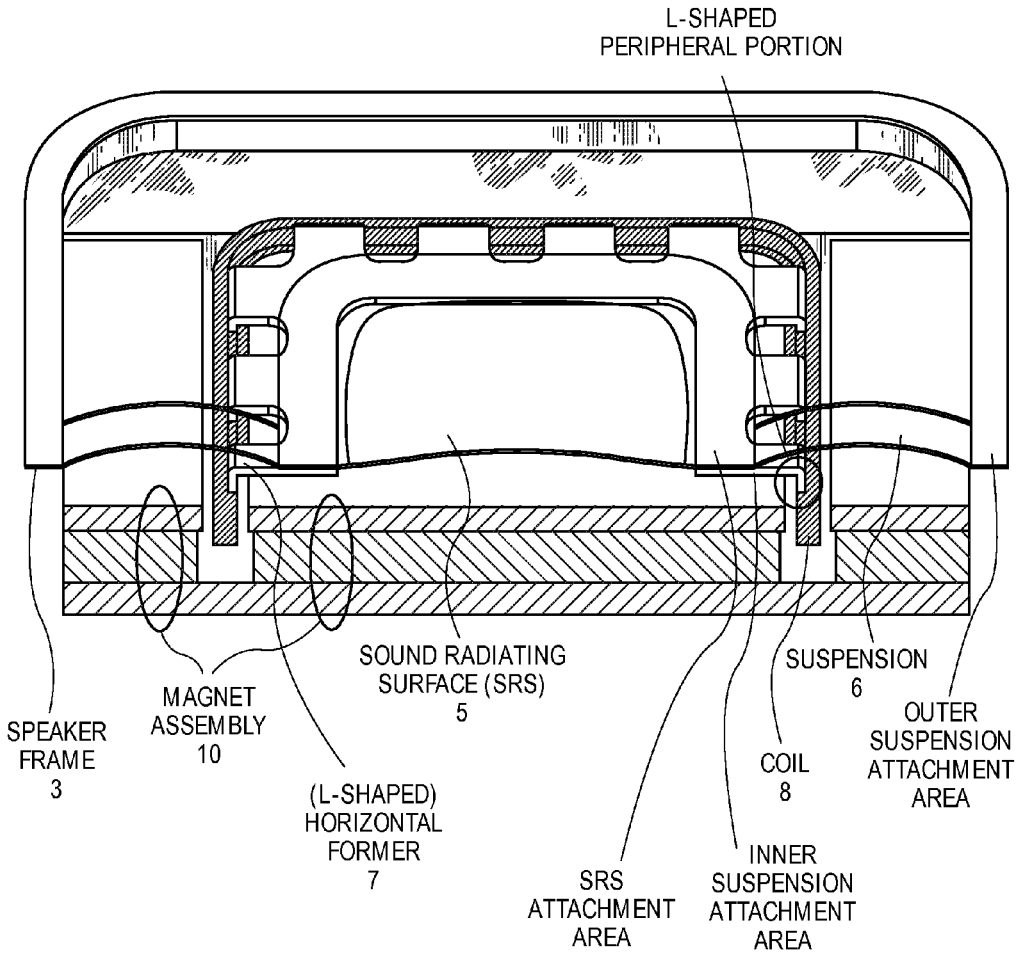
FIG. 4 is an angle view of a speaker in accordance with another embodiment of the invention, where the peripheral portion of the horizontal former has an L-shape.
Figure 5:
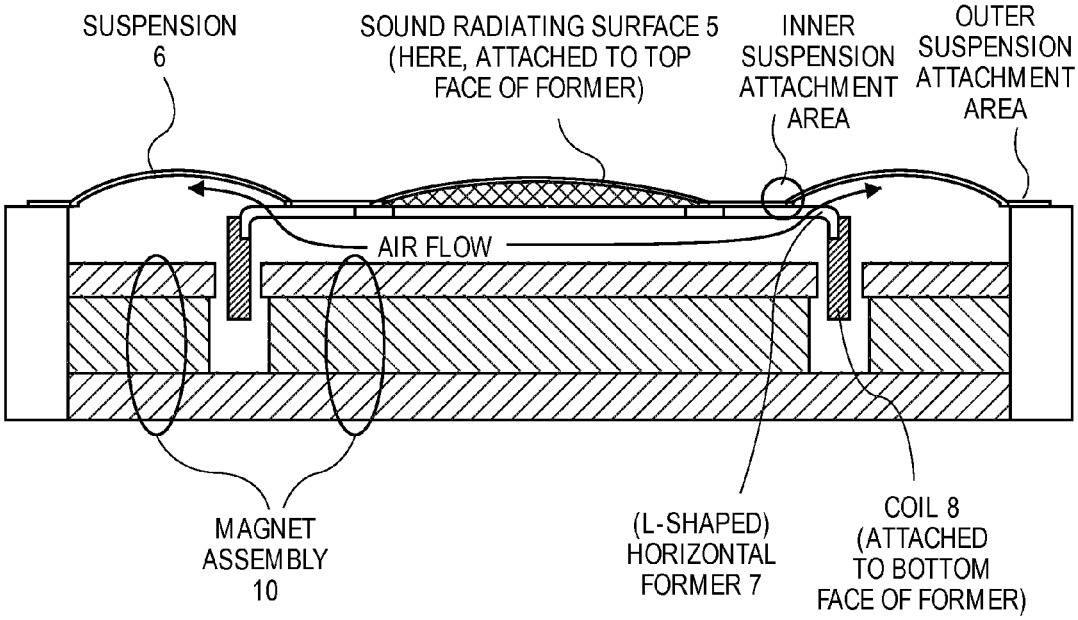
FIG. 5 is a side view of the embodiment of FIG. 4.
Figure 6:
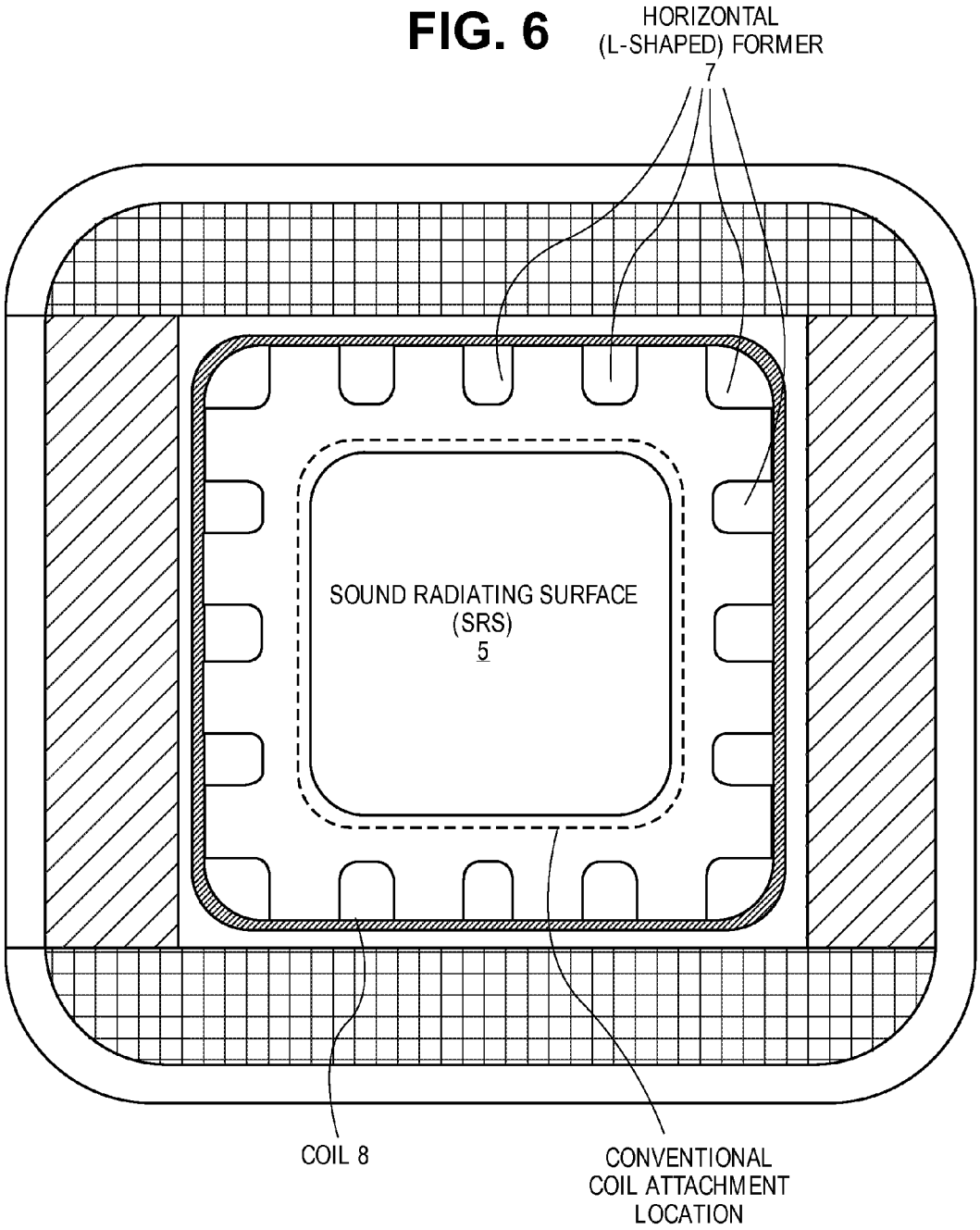
FIG. 6 is a top view of the embodiment of FIG. 4.

Referring now to FIGS. 4-6, another embodiment of the invention is shown, where the horizontal former 7 has an L-shaped peripheral portion, rather than a flat one. The coil 8 in this case may be attached (e.g., directly bonded) to the vertical segment of the L-shape, while the horizontal segment of the L-shape may be substantially the same as the flat peripheral portion of the embodiments of FIGS. 1-3. This embodiment may be manufactured by simply bending downwards the ends of the fingers of the horizontal former 7 of FIGS. 1-3, into the L-shape depicted in FIGS. 5-6. This embodiment may allow the coil 8 to be positioned deeper within the gap of the magnet assembly 10. In addition, this embodiment may allow the coil to be easily wound around the vertical segments of the peripheral portions of the horizontal former 7, allowing the former 7 to be used in forming the coil's shape. The coil would then be fixed in place by the application of a suitable adhesive or lacquer. Other aspects of this embodiment may be substantially similar to those described for the embodiment of FIGS. 1-3, including the holes that have been formed, in this case, at the outside edge or corner of each of the L-shaped portions of the horizontal former 7.

A speaker in accordance with an embodiment of the invention may have a horizontal former 7 which is a separate piece, and to which the suspension 6 and the sound radiating surface 5 are attached, as suggested in the figures. In particular, the suspension 6 may be a membrane that has an outer attachment area on the frame 3, and an inner attachment area on a top face of the horizontal former 7—see FIG. 4. The suspension 6 may thus be viewed as being anchored to the frame 3. In addition, the membrane may extend across the entire top face of the former 7 and be attached to the top face, for instance, all along the annular portion of the former 7 (as depicted in FIG. 4 as well as in FIG. 1). In particular, a bottom face of the membrane may be glued to the top face of the former 7 along the entire annular portion. A relatively rigid plate or dome may be attached, e.g. directly glued, to the top face of the membrane, the plate or dome having a periphery that is coextensive with the annular region of the former 7. This may be seen in FIG. 3, showing the annular region of the horizontal former 7, being a top face of the former 7, where the sound radiating surface 5 and the suspension 6 have been attached.

As seen in FIG. 1, the horizontal former 7 extends substantially horizontally outward of where the suspension 6 could be attached, to a peripheral portion—see FIG. 2. It is at this peripheral portion of the horizontal former 7 where the coil 8 is attached, thereby allowing the size or area of the coil 8 to be substantially larger than the conventional coil attachment location depicted in FIG. 2. Of course, it is understood that the magnet assembly 10 would also be made larger, so as to position the gap in vertical alignment with the attached coil 8 (see FIG. 1). In this arrangement, it should also be noted that the peripheral portion of the horizontal former 7, as a result, is located substantially vertically below a suspended region of the suspension 6, where that region lies between an region at which the suspension 6 is attached to the former 7, and an region at which the suspension 6 is attached to the frame 3. This can be clearly seen in the side view of FIG. 3, as well as the side view of FIG. 5, where the coil 8 is said to be entirely "underneath" the suspension 6. This positioning of the coil 8 also allows airflow between the space just beneath the suspension 6 and the space just behind the sound radiating surface 5, through one or more holes that may be formed in the peripheral portion of the former 7—see FIG. 3 and FIG. 5.

A process of manufacturing the speaker described above, and in particular the assembly that includes the suspension 6, sound radiating surface 5, horizontal former 7, and coil 8, may proceed as follows. The coil 8 may be obtained as a pre-wound unit, which is then secured to the bottom face of the horizontal former 7, along the peripheral portions thereof. As an alternative, the horizontal former may have an L-shaped peripheral portion, so that the coil 8 could be secured to the vertical segment instead (e.g., wound around the vertical segment and then secured, to form a single piece with the former 7). Also, holes or openings may have been cut into the periphery of the former 7 (e.g., in accordance with the multi-fingered arrangement depicted in the figures). Next, the sound radiating surface 5, which may be a rigid plate or dome is attached to the top face of the former 7, along the annular portion thereof. At the same time, or just before or just after, an inner region of the suspension 6 is attached to the top face of the horizontal former 7, also in the annular portion thereof.

In the above manufacturing process, the former 7 may have been manufactured as a separate piece than the cone (sound radiating surface 5). However, as an alternative, the former 7 and the sound radiating surface 5 may be manufactured as a single piece, for instance, as a solid plate with no central opening therein. Such a former-cone element could be milled, cut or stamped from a solid sheet of material such as aluminum alloy (or other suitably lightweight yet rigid material). Note in that case there would be no annular portion to speak of (in the former 7), and the central region of the former 7 would inherently provide the majority of the effective piston area of the sound radiating surface. The manufacturing process would otherwise remain the same, including the operation of attaching the suspension 6 to the top face of the former-cone element (inward of the peripheral edge).

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, although the drawings show the gap in the magnet system, the coil, and the horizontal former all having essentially the same rectangular or square shape, an alternative may be a substantially elliptical or oval shape or even round in shape. The description is thus to be regarded as illustrative instead of limiting.

What is claimed is:

1. A speaker comprising:

a frame;

a sound radiating surface;

a suspension that couples the sound radiating surface to the frame to allow substantially vertical movement of the sound radiating surface relative to the frame;

a horizontal former being a separate piece that has a central opening bounded by an annular portion to which the sound radiating surface is bonded, the horizontal former extending substantially horizontally outward of a peripheral portion of the sound radiating surface to a peripheral portion that is separate from the suspension; and a coil coupled to the peripheral portion of the horizontal former in such a manner that the area spanned by the coil is larger than the area of the sound radiating surface.

2. The speaker of claim 1 wherein the suspension comprises an annular surround that is attached to the sound radiating surface along a peripheral portion of the sound radiating surface.

3. The speaker of claim 1 wherein the suspension is to maintain the sound radiating surface in substantial alignment relative to a center vertical axis of the radiating surface.

4. The speaker of claim 1, wherein the suspension is more flexible than the sound radiating surface.

5. The speaker of claim 1 wherein the suspension is a single-piece flexible membrane, and wherein the sound radiating surface comprises a rigid plate or dome that is attached to the annular portion of the horizontal former.

6. The speaker of claim 1 wherein the frame is part of a speaker enclosure or box whose speaker back volume is in the range of about 0.5 cubic cm to 2 cubic cm.

7. The speaker of claim 1 further comprising a speaker magnet assembly having an air gap in which the coil is received.

8. The speaker of claim 1 wherein the peripheral portion of the horizontal former is entirely flat, wherein the coil is attached to the bottom face of the flat peripheral portion.

9. The speaker of claim 1 wherein the peripheral portion of the horizontal former has an L-shape including a horizontal segment and an adjoining vertical segment, wherein the coil is attached to the vertical segment.

10. The speaker of claim 1 wherein the horizontal former has a plurality of holes formed therein through which there is air flow between (a) a space just behind the suspension and (b) a space just behind the sound radiating surface.

11. The speaker of claim 10 wherein the former the annular portion is positioned inward of the plurality of holes.

12. The speaker of claim 11 wherein the sound radiating surface is a separate piece that is bonded to a top of the annular portion.

13. The speaker of claim 1 wherein the former has a plurality of fingers formed in its peripheral portion, wherein the coil is bonded to the plurality of fingers in such a way that leaves uncovered some open areas between the fingers.

14. The speaker of claim 13 wherein the former has a central opening bounded by an annular portion that is positioned inward of the plurality of fingers.

15. A speaker comprising:

a frame;

a sound radiating surface;

a suspension that couples the sound radiating surface to the frame to allow substantially vertical movement of the sound radiating surface relative to the frame;

a horizontal former to which the suspension and the sound radiating surface are attached, the horizontal former extending substantially horizontally outward of where the suspension is attached to the horizontal former; and a coil attached to a peripheral portion of the horizontal former.

16. The speaker of claim 15 wherein the peripheral portion of the horizontal former is located substantially vertically below a suspended region of the suspension that lies between (a) a region at which the suspension is attached to the former and (b) a region at which the suspension is attached to the frame.

17. The speaker of claim 15 wherein the horizontal former has a plurality of holes formed therein that are located outward of a region at which the suspension is attached to the former.

18. The speaker of claim 15, wherein a bottom face of the suspension is bonded directly to a top face of the former, and wherein the former is a separate piece than the sound radiating surface.

19. The speaker of claim 15 wherein the peripheral portion of the horizontal former has an L-shape including a horizontal segment and an adjoining vertical segment, wherein the coil is attached to the vertical segment.

20. The speaker of claim 15 wherein the former has a central opening bounded by an annular portion that is positioned inward of a plurality of holes.

21. The speaker of claim 20 wherein the sound radiating surface is a separate piece that is bonded to a top of the annular portion.

22. The speaker of claim 15 wherein the former has a central opening bounded by an annular portion to which the sound radiating surface is bonded.

23. The speaker of claim 15 wherein former has a plurality of fingers formed in its peripheral portion, wherein the coil is bonded to the plurality fingers but leaves uncovered the open areas between the fingers.

24. The speaker of claim 23 wherein the former has a central opening bounded by an annular portion that is positioned inward of the plurality of fingers.

* * * * *